United States Patent [19]

Hanna

[11] Patent Number: 4,998,080

[45] Date of Patent: Mar. 5, 1991

[54] MICROWAVE CHANNELIZER BASED ON COUPLED YIG RESONATORS

[75] Inventor: Samy M. Hanna, Farmingdale, N.Y.

[73] Assignee: Polytechnic University, Brooklyn, N.Y.

[21] Appl. No.: 360,216

[22] Filed: Jun. 2, 1989

[51] Int. Cl.[5] ..... H01P 1/217

[52] U.S. Cl. ..... 333/202; 333/219.2; 333/235; 333/132

[58] Field of Search ..... 333/133, 132, 219, 219.2, 333/201, 202, 204, 205, 235

[56] References Cited

U.S. PATENT DOCUMENTS

| | | | |
|---|---|---|---|
| 3,611,197 | 10/1971 | Moore et al. | 333/204 |
| 3,913,039 | 8/1974 | Weiner | 333/205 |
| 4,169,252 | 9/1979 | Muskiewicz | 333/205 |
| 4,500,858 | 2/1985 | Mezak | 333/202 |
| 4,528,529 | 7/1985 | Huijer | 333/235 X |
| 4,547,754 | 10/1985 | Murakami et al. | 333/219 |
| 4,614,919 | 9/1986 | Floyd | 333/133 |
| 4,679,015 | 7/1987 | Murakami et al. | 333/219 |
| 4,716,390 | 12/1987 | Elliott et al. | 333/202 |
| 4,745,380 | 5/1988 | Murakami et al. | 333/234 |
| 4,751,480 | 6/1988 | Kunz et al. | 333/219 |
| 4,777,462 | 10/1988 | Kunz et al. | 333/202 X |
| 4,782,312 | 11/1988 | Chang et al. | 333/202 X |

OTHER PUBLICATIONS

Hanna, S. M. and Zeroug, S.; "Single and Coupled MSW Resonators for Microwave Channelizers", *IEEE Transactions in Magnetics,* Nov. 1988, pp. 2808–2810.

Hanna, S. M. and Zeroug, S.; "Frequency Sorting Based on Planar YIG Resonators", *Proceedings of the 42nd Frequency Control Symposium,* Jun. 1–3, 1988, pp. 112–115.

*Primary Examiner*—Eugene R. Laroche
*Assistant Examiner*—Seung Ham
*Attorney, Agent, or Firm*—Curtis, Morris & Safford

[57] ABSTRACT

A coupled YIG resonator device for filtering a wide band microwave signal to provide a comparatively narrow output passband. The device has an enhanced bandwidth and improved out-of-band rejection relative to a single resonator configuration. The coupled resonator device includes a plurality of YIG films sharing a common non-magnetic substrate arranged in a plane and having a gap separating adjacent films. A dielectric layer has a first surface in contact with the YIG films and a second surface where a metallic ground plane is deposited. A magnetic biasing field is applied to the plurality of YIG films such that each forms a resonator having a resonance frequency. Adjacent resonators are magnetically coupled to each other by rf linkage across the gap therebetween. The magnetic coupling causes the respective resonance frequencies of the respective resonators to move apart relative to respective resonance frequencies occurring when no coupling is present, thereby enhancing the bandwidth and improving the out-of-hand rejection of the coupled resonator circuit. The center frequency of respective resonator circuits may be tuned by prescribing differing dimensions of the respective resonator circuits and applying a uniform magnetic biasing field. A microwave channelizer is comprised of a plurality of the aforementioned coupled YIG resonators integrated into one device. The channelizer separates microwave signals of different frequencies into individual output channels.

2 Claims, 6 Drawing Sheets

MICROWAVE CHANNELIZER BASED ON COUPLED YIG RESONATORS

FIELD OF THE INVENTION

This invention relates to yttrium iron garnet (YIG) resonators and, more particularly, to YIG resonators for microwave channelizers having expanded bandwidth and improved out-of-band rejection. The invention implements magnetostatic waves (MSW).

BACKGROUND OF THE INVENTION

A YIG resonator is a YIG film grown on a non-magnetic substrate such as gadolinium gallium garnet (GGG) and exposed to a biasing field. Such resonators are useful for microwave integrated circuit filters due to a high Q value resonance characteristic in the microwave frequency band, a compact planar structure, and suitability for mass production by selective patterning processes.

Epitaxially grown YIG films have low magnetic losses, thereby providing a good propagation medium for magnetostatic waves. Typically, a single YIG resonator is provided for each channel of a microwave channelizer to filter a narrow band signal from a wide band (or multi-channel) microwave input signal. More specifically, a microwave channelizer subdivides wide band signals in the range of 1 gigahertz and higher into a plurality of comparatively narrow band signals. Each channel filters the wide band signal to pass a particular narrow band signal. For magnetostatic waves (MSW) propagating in a YIG film of certain dimensions, the resonator dimensions and the bias magnetic field define a pass band center frequency of a respective channel.

In general, YIG resonators have applications for microwave filters, oscillators and communication systems.

Referring to FIG. 1, a typical YIG resonator 10 is shown in which a YIG film 12 of thickness d is epitaxially grown in a non-magnetic GGG substrate 14. Two microstrip lines 16,18 couple microwave energy into and out of the resonator 10 to provide respective input and output signal paths. The lines 16,18 are formed on a dielectric material 20 of height h. The YIG film 12 is disposed on the same material which separates the lines 16,18 and the film 12 from a metallic ground plane 22.

Magnetostatic waves typically are generated by passing current through a wire or conductor (such as lines 16 and 18) adjacent to the YIG film. The rf magnetic field surrounding the wire induces MSW propagation in the YIG film. The YIG film functions, in effect, as a waveguide.

A forward surface wave is propagated in the film 12 if a magnetic biasing field H is applied in the plane of the YIG film perpendicular to the direction of propagation. A forward volume wave is propagated if the magnetic biasing field H is applied normal to the plane of the YIG film 12. A backward volume wave is propagated if the magnetic biasing field H is in the plane of the YIG film in the direction of propagation. In FIG. 1, the magnetic biasing field $H_0$ is applied normal to the plane of the YIG film 12 to propagate magnetostatic forward volume waves.

Conventionally, the resonator is tuned by altering the field strength of the magnetic biasing field and thereby altering the permeability of the YIG film and the center frequency of the resonator 10.

As shown in FIG. 2, a microwave channelizer 30 typically is formed of several resonators **32*a*, 32*b*, 32*c*,** . . . forming a filter bank so that each resonator forms a separate channel for filtering a signal of particular frequency from a wide band microwave input signal $S_i$. As practiced, each channel includes identically proportioned YIG films and the resonators or delay lines are subjected to a gradient of a magnetic biasing field (not shown). Thus, each resonator (or delay line) is exposed to a magnetic biasing field with a different intensity, and as a result has a different center frequency. The channelizer enables spectral analysis of a microwave input signal by receiving the input signal $S_i$ at each resonator and passing as the output signal $S_o$ from the resonator, only the narrow band of frequencies about the resonator's center frequency.

A problem with using a YIG resonator in certain applications is that the passband may be narrower than desireable.

OBJECTS OF THE INVENTION

Therefore, it is an object of the invention to provide a YIG resonator with an enhanced passband.

It is another object of the invention to provide a microwave channelizer having coupled YIG resonators configured to form a filter having a more rectangular passband and an improved out-of-band rejection than prior art configurations implementing a delay line approach.

It is another object of the invention to provide a microwave channelizer having a plurality of channels formed by coupled YIG resonators exposed to a common magnetic biasing field of uniform intensity having an expanded bandwidth and improved out-of-band rejection.

SUMMARY OF THE INVENTION

These and other objects of the invention are provided by coupling YIG resonators to form a single channel of a multi-channel microwave channelizer. The coupled resonators are formed with a plurality of YIG films spaced a predetermined distance apart on a common non-magnetic substrate, such as gadolinium gallium garnet (GGG). The YIG films are disposed on a dielectric material on the surface opposite the non-magnetic substrate. A gap between the films enables rf magnetic coupling between the resonating films, thereby altering the respective resonance frequencies.

The resonance frequencies of respective resonating films are forced apart resulting in a wider passband of the coupled resonators. In addition to an enhanced bandwidth, the coupling results in an improvement in the out-of-band rejection. The coupled resonators thus receive a wide band microwave input signal and pass a narrow band output signal having an enhanced bandwidth and increased out-of-band rejection.

The coupled resonators from differing channels also may have differing dimensions so as to provide differing resonance frequencies and thus differing passbands. In such case, the resonators are exposed to a common magnetic biasing field which does not require a gradient, but instead is of uniform intensity a the surfaces of the respective YIG films.

DETAILED DESCRIPTION

Figure 3:
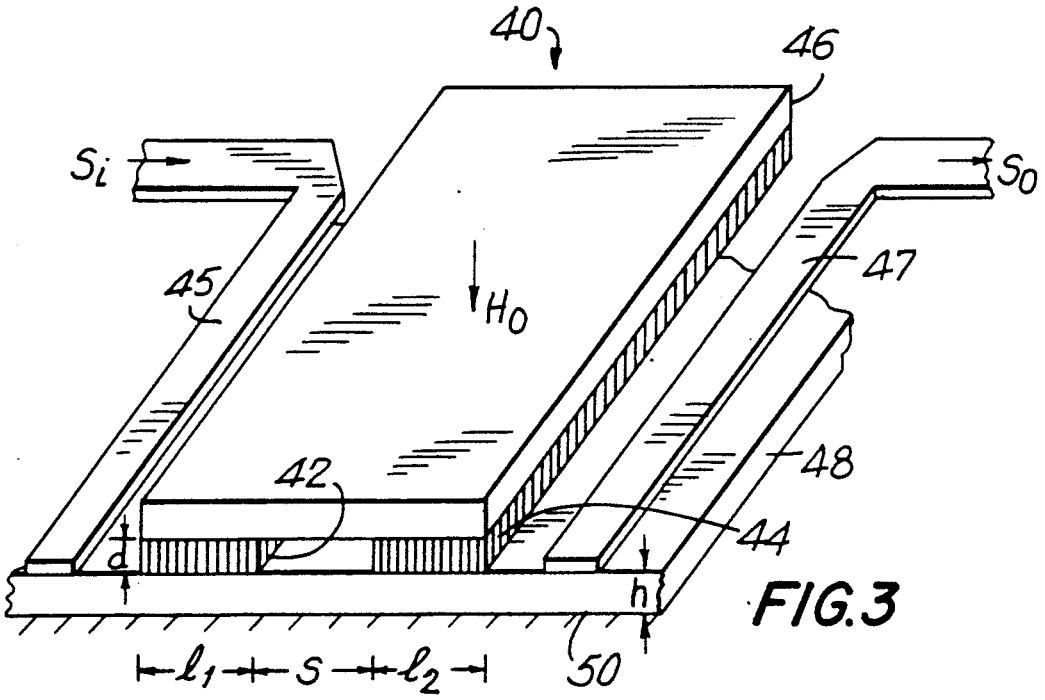
FIG. 3 is a diagram of an embodiment of coupled YIG resonator device according to this invention.
Figure 2:
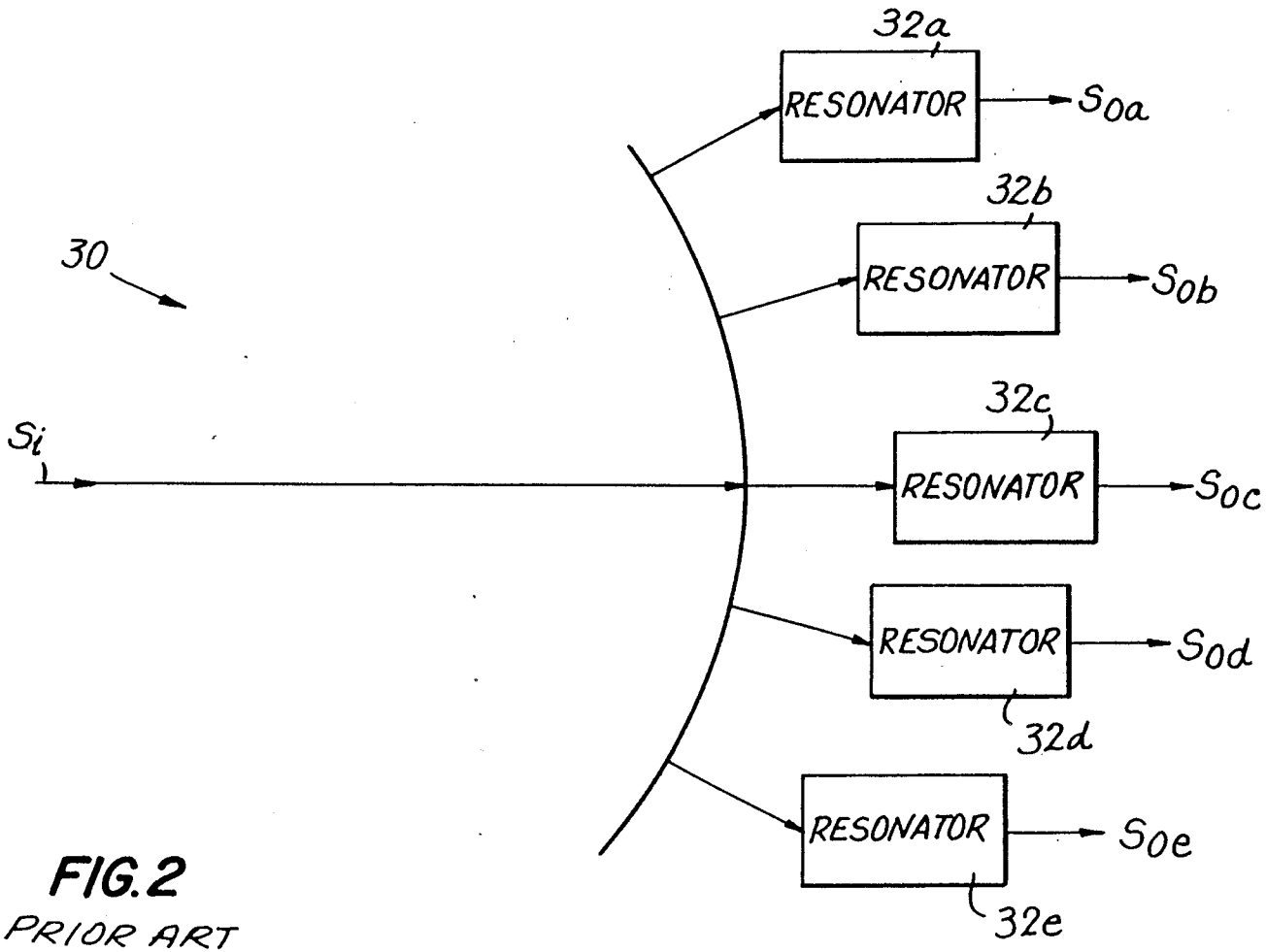
FIG. 2 PRIOR ART
FIG. 2 is a diagram of a conventional microwave channelizer implemented by delay lines or resonators.

Referring to FIG. 3, two yttrium iron garnet (YIG) films 42, 44 each of thickness d (such as 92 micrometers) are grown on a common non-magnetic substrate 46, such as gadolinium gallium garnet (GGG). The films 42,44 are disposed on and, thus, are in contact with, a dielectric 48, such as Duroid, of thickness h (on the order of about 0.25 mm) which separates the films from a ground plane 50. The films 42,44 with the substrate 46, dielectric 48 and ground plane 50 form a resonator device 40. When a magnetic biasing field $H_o$ of predetermined intensity is applied, the films perform as a coupled resonator. In operation, a wide band microwave input signal $S_i$ is input to the resonator along a transmission microstrip 45. The resonance characteristics of the resonator then extract a comparatively narrow band output signal $S_o$ which is output along a transmission microstrip 47.

As illustrated, a magnetic biasing field $H_o$ is applied normal to the plane of the films 42,44 to cause magnetostatic forward volume waves. For a predetermined magnetic field, such as 2.75 kOe and given YIG film dimensions the films 42,44 resonate with magnetostatic waves propagating through the films.

Sandwiching the YIG films between the substrate 46 and the dielectric 48 allows the gap s separating the films 42 and 44 to provide rf linkage of the resonant films when exposed to a magnetic biasing field. The respective films 42,44, as a result, form two resonators magnetically coupled through rf linkage. Such a gap s may be introduced while dicing a YIG sample into a specified rectangular shape using a wafer saw. An approximate gap is in the range 1.25 to 1.35 mm, and good results have been obtained for s=1.29 mm and s=1.33 mm. The magnetic coupling, in effect, moves the resonance frequencies of the component resonators farther apart. As applied to a microwave channelizer, the coupled resonators have a broader band and together form a single-channel filter having an enhanced passband.

The resonance band of the coupled resonators may be represented by the following equation:

$$w_+ = (w_1 + w_2)/2 + d_w;$$
$$w_- = (w_1 + w_2)/2 - d_w;$$

where, $w_1$ = resonance frequency of uncoupled resonator with *YIG* film 42;

-continued $w_2$ = resonance frequency of uncoupled resonator with *YIG* film 44;

$d_w$ = separation in frequency caused by coupling.

The stronger the coupling, the larger the factor dw. By changing the gap s, the strength of the coupling is altered and correspondingly the passband of the coupled resonator circuit 40 is altered. Thus, control of the passband is achieved by defining the gap s to achieve a prescribed frequency.

Figure 1:
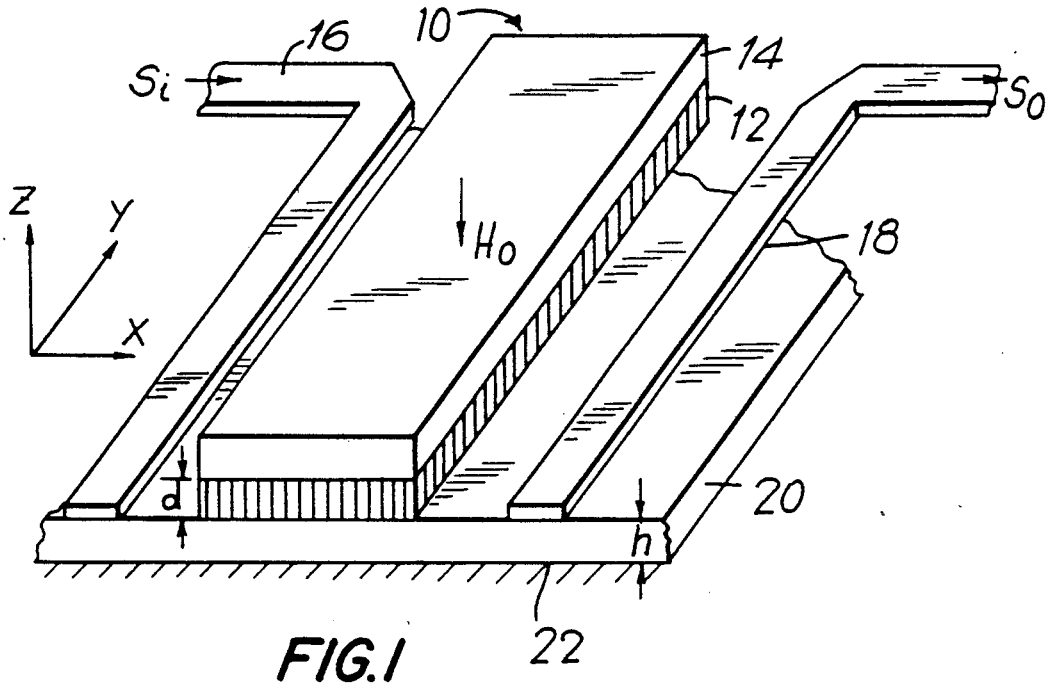
FIG.1 PRIOR ART
FIG. 1 is a diagram of a conventional configuration of a YIG resonator.
Figure 4:
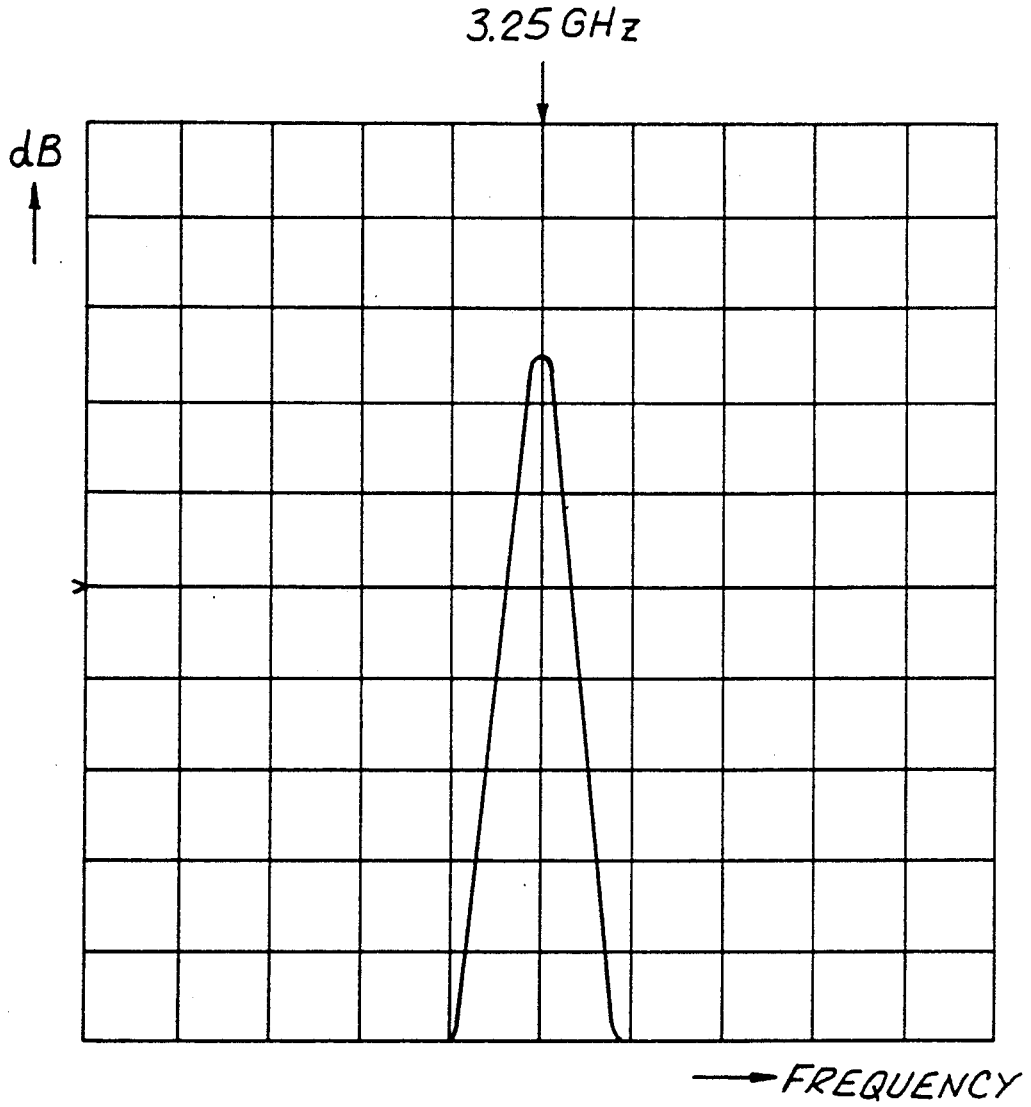
FIG. 4 is a graphical representation of the transmission response of the YIG resonator of FIG. 1.
Figure 5:
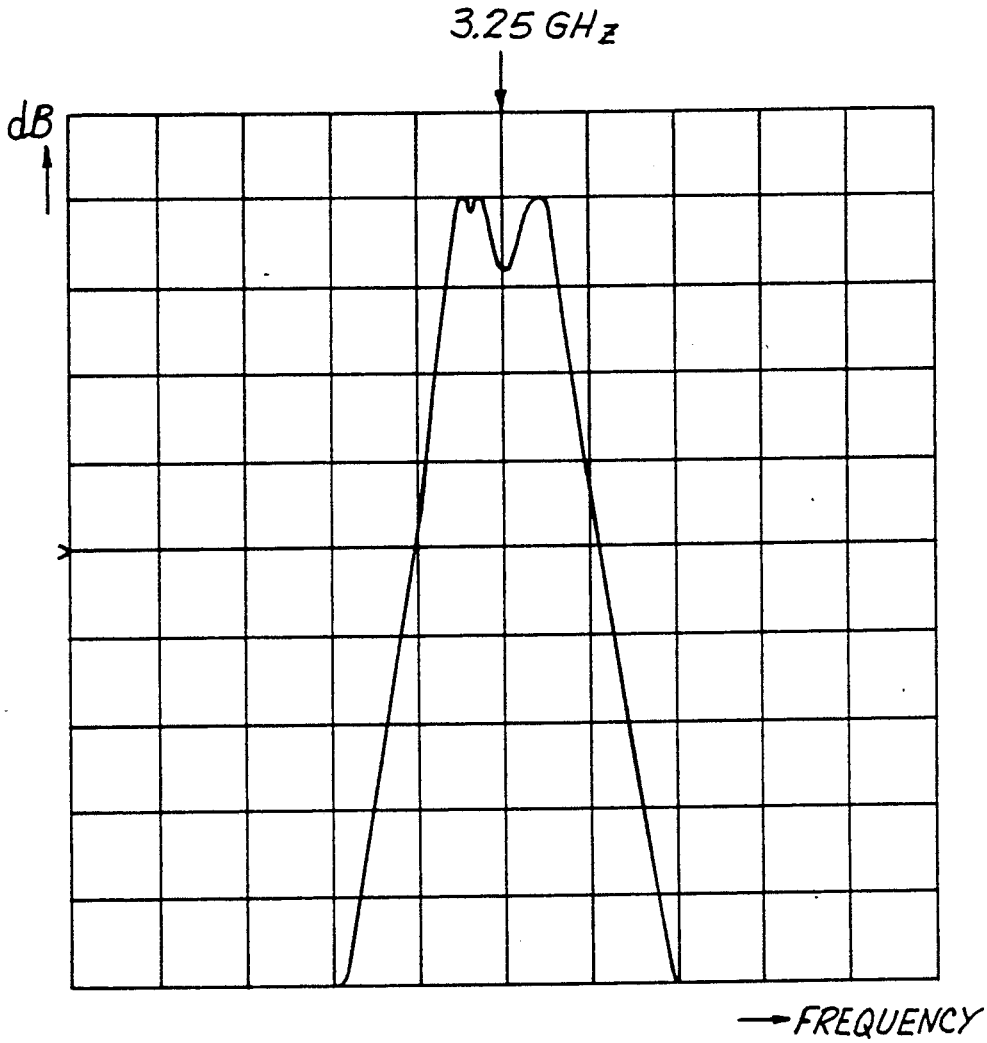
FIG. 5 is a graphical representation of the transmission response of the coupled YIG resonator circuit of FIG. 3 operating at the same frequency used to obtain the FIG. 1 resonator response shown in FIG. 4.

Referring to FIGS. 4 and 5, the transmission responses are shown for identical operating frequencies of the respective single resonator 10 (FIG. 1) and the coupled resonator device 40 (FIG. 3). To achieve the exemplary band broadening illustrated, a spacing s of 40–50 mils is used. It is to be noticed that while the 3-dB bandwidth for the single resonator 10 is approximately 4 to 7 MHz, the 3-dB bandwidth of the coupled resonator device 40 is more than 10 MHz. Specifically, FIG. 4 shows that the 3-dB bandwidth transmission response of the single resonator 10 is approximately 6.4 MHz, while FIG. 5 shows that the 3-dB bandwidth transmission response of the coupled resonator device 40 is approximately 10.5 MHz.

As described, the bandwidth of the coupled resonator device 40 may be increased by increasing the strength of the coupling. However, as the coupling strength increases beyond a critical coupling level the flatness of the passband degrades.

Figure 6:
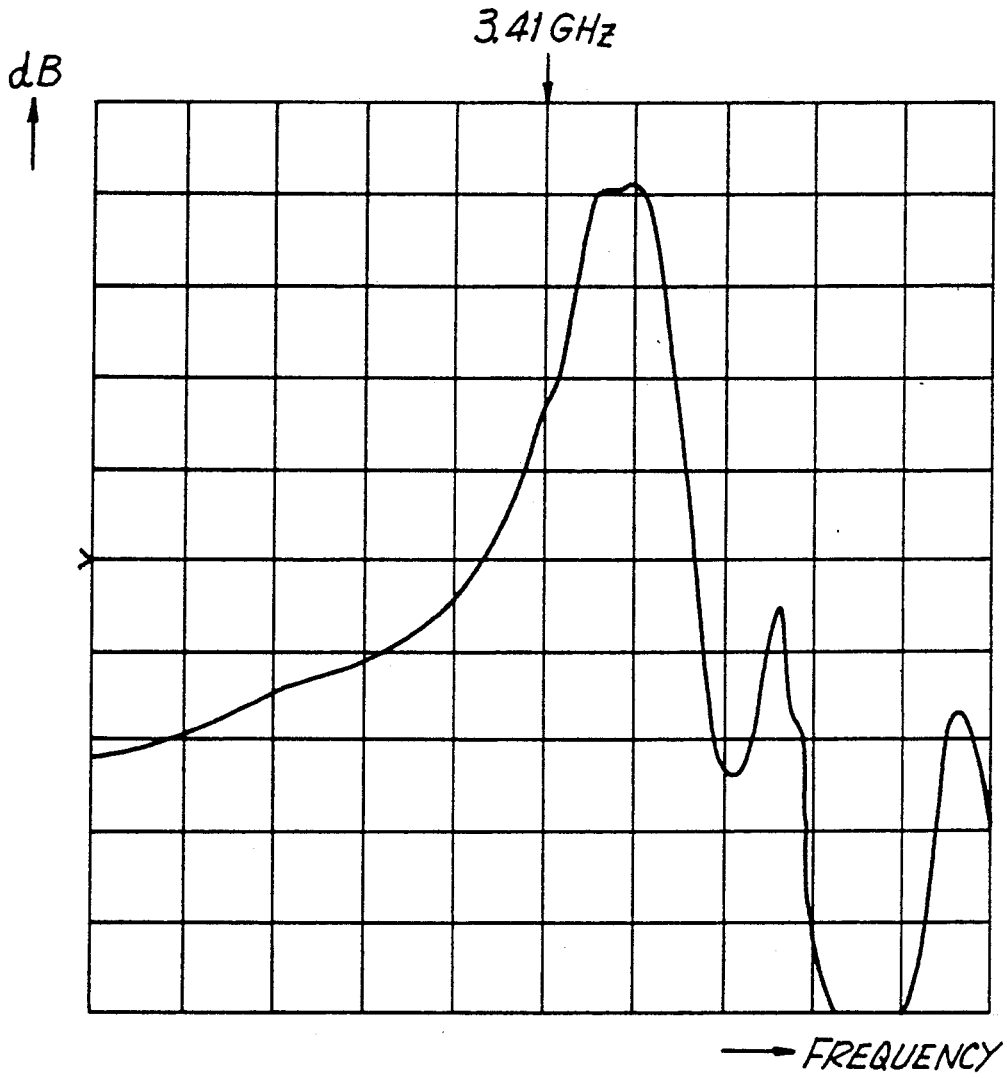
FIG. 6 is a graphical representation of the transmission response of the coupled YIG resonator circuit of FIG. 3 when the component resonators are critically coupled.

Referring to FIG. 6, the transmission response for critically coupled resonators is shown. As illustrated, the passband has reasonable flatness.

The coupled resonator device 40 also exhibits improved out-of-band rejection relative to the single resonator 10. Spurious resonances from higher resonant modes which cause significant degradation in the out-of-band rejection of the single resonator 10 are more effectively suppressed in the coupled resonator device 40. Specifically, the out-of-band rejection for the described circuits improves from approximately 10 to 15 dB for the single resonator 10 to approximately 20 to 25 dB for the coupled resonator device 40, as shown in FIG. 6.

Figure 7:
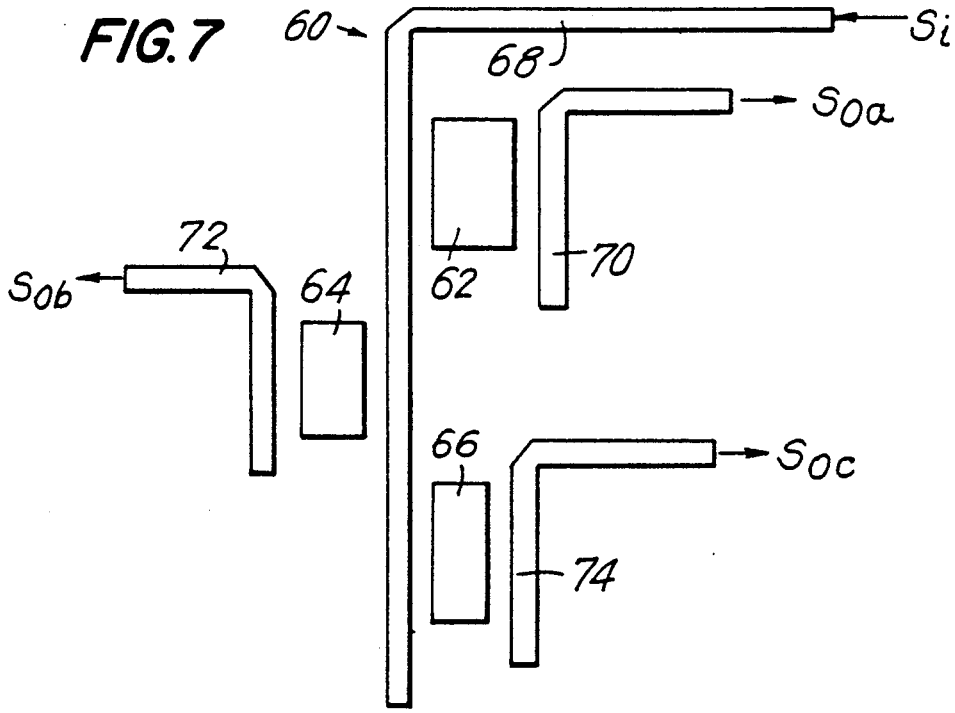
FIG. 7 is a diagram of a multi-channel microwave channelizer of this invention.

Referring to FIG. 7, a microwave channelizer 60 formed of coupled resonators according to this invention is shown. The channelizer 60, as illustrated, has three channels although more or less channels may be similarly implemented according to the requirements of a particular application. The first channel includes a coupled resonance device 62 formed of the circuit 40 which has been described in FIG. 3. The second channel similarly includes another coupled resonance device 64. The third channel likewise includes a further coupled resonance device 66. Each channel receives a wide band microwave input signal $S_i$ via a transmission microstrip 68. Coupled resonance device 62 filters the signal $S_i$ to extract a signal $S_{oa}$ of a first channel which is output via transmission microstrip 70. Coupled resonance device 64 similarly filters the signal $S_i$ to extract an output signal $S_{ob}$ of a second channel which is output via transmission microstrip 72. Coupled resonance device 66 filters the signal $S_i$ to extract an output signal $S_{oc}$ of a third channel which is output via transmission microstrip 74. The coupled resonator devices 62, 64, 66 are exposed to a magnetic biasing field (not shown) normal to the plane of the resonators to cause magnetostatic forward volume waves.

A feature of a YIG resonator is its tunability. Typically, the frequency response of a resonator is tuned to different frequencies by varying the magnetic biasing field. Accordingly, to achieve different frequency response characteristics for the respective channels and thus differing filter passband center frequencies, a gradient in the magnetic biasing field may be applied. However, when using the present invention, tuning may be achieved by selecting different dimensions for the coupled resonators of the respective channels. By altering the dimensions, the resonating characteristics also are altered. Thus, each channel may exhibit different resonance frequencies and thus different bandpass center frequencies when exposed to a prescribed uniform magnetic biasing field simply by selecting these dimensions judiciously. As illustrated, FIG. 7 shows coupled resonators having differing length and width dimensions.

Figure 8:
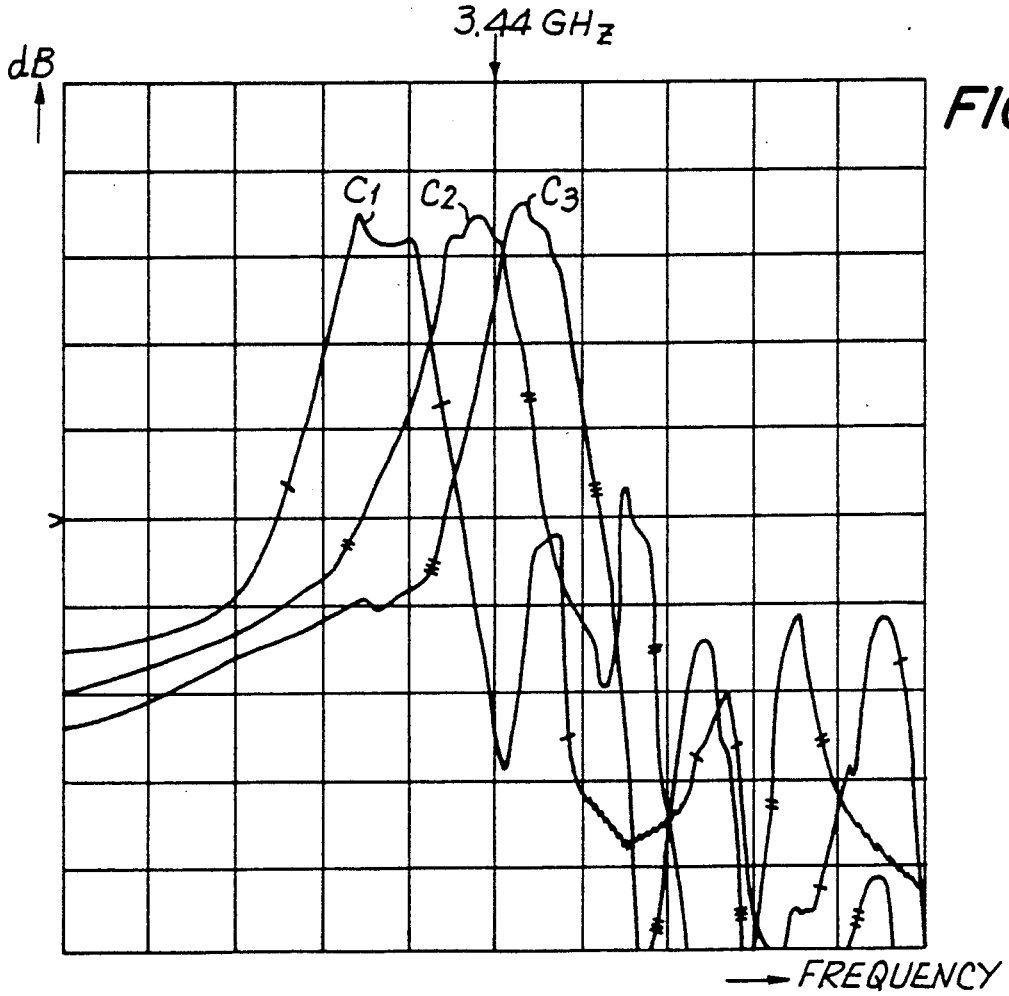
FIG. 8 is a graphical representation of the frequency response of the channelizer of FIG. 7.

Referring to FIG. 8, the frequency response is shown for a three channel microwave channelizer subject to uniform magnetic biasing and having coupled resonators of the respective channels dimensioned to provide differing passbands. The curves $C_1$, $C_2$, and $C_3$ identify the frequency responses for the respective channels.

While embodiments of the invention have been illustrated and described, the invention is not intended to be limited to the exact embodiments illustrated. The scope of the invention is intended to be determined by the claims an their equivalents interpreted in light of the prior art.

What is claimed is:

1. A microwave channelizer comprising:

plural coupled resonator devices, each having a plurality of YIG films arranged in a plane with a surface of each of said film in a device in contact with a common non-magnetic substrate and having a gap separating adjacent films;

a dielectric layer having a first surface in contact with said plural coupled resonator devices;

a ground plane deposited on a second surface of said dielectric layer; and a common magnetic biasing field of uniform intensity applied to said plural coupled resonator devices such that each of said YIG films in a device forms a resonator having a resonance frequency with adjacent resonators being magnetically coupled to each other by rf linkage across the gap therebetween, said magnetic coupling causing the respective resonance frequencies of the respective resonators in a device to move apart relative to respective resonance frequencies occurring when no coupling is present, thereby enhancing the bandwidth and improving the out-of-band rejection of the channel.

2. A microwave channelizer having a plurality of channels, each channel comprising a coupled resonator device exposed to a common magnetic field of uniform strength at each coupled resonator device with the respective coupled resonator devices structured to have differing dimensions to exhibit corresponding different resonance frequencies, comprising:

plural coupled resonator devices, each having a plurality of YIG films arranged in a plane with a surface of each of said films in a device in contact with a common non-magnetic substrate and having a gap separating adjacent films;

a dielectric layer having a first surface in contact with said plural coupled resonator devices;

a ground plane deposited on a second surface of said dielectric layer; and a common magnetic biasing field of uniform intensity applied to said plural coupled resonator devices, each of said YIG films in a device forming a resonator and dimensioned to exhibit a particular resonance frequency, such that adjacent resonators are magnetically coupled to each other by rf linkage across the gaps therebetween.

* * * * *